US006349867B1

(12) United States Patent
Fernfors

(10) Patent No.: US 6,349,867 B1
(45) Date of Patent: Feb. 26, 2002

(54) APPARATUS FOR TRANSPORTING CONTINUOUS ELONGATE MATERIAL WEBS

(75) Inventor: Ingemar Fernfors, Mölndal (SE)

(73) Assignee: SCA Hygiene Products AB, Goteborg (SE)

( * ) Notice: Subject to any disclaimer, the term of this patent is extended or adjusted under 35 U.S.C. 154(b) by 0 days.

(21) Appl. No.: 09/187,889

(22) Filed: Nov. 6, 1998

(30) Foreign Application Priority Data

Nov. 10, 1997 (DE) ..... 197 49 593

(51) Int. Cl.[7] ..... B65H 20/24; B65H 23/32; B32B 31/00

(52) U.S. Cl. ..... 226/113; 156/265; 156/495; 83/38; 242/615.21

(58) Field of Search ..... 226/113, 114, 226/109, 110; 83/38; 156/73.5, 264, 265, 495, 496

(56) References Cited

U.S. PATENT DOCUMENTS

| | | | | |
|---|---|---|---|---|
| 1,905,446 A | * | 4/1933 | Dewey et al. | 226/114 X |
| 3,613,978 A | * | 10/1971 | Renold | 226/113 X |
| 3,877,628 A | * | 4/1975 | Asselin et al. | 226/113 |
| 4,180,194 A | * | 12/1979 | McCombie et al. | 226/113 |
| 4,711,562 A | * | 12/1987 | Pothast et al. | 226/114 X |
| 4,778,093 A | * | 10/1988 | Renold | 226/113 |
| 5,251,988 A | * | 10/1993 | Frazier | 226/113 X |
| 5,277,571 A | | 1/1994 | Brining | |
| 5,371,521 A | * | 12/1994 | Wehrmann | 226/113 X |
| 5,558,263 A | * | 9/1996 | Long | 226/114 |
| 6,065,521 A | * | 5/2000 | Tharpe, Jr. et al. | 156/543 |

FOREIGN PATENT DOCUMENTS

| | | |
|---|---|---|
| CH | 360269 | 3/1962 |
| DE | 456250 | 4/1926 |
| DE | 28 48 872 C2 | 3/1985 |
| GB | 1065161 | 4/1967 |
| WO | WO95/12491 | 5/1995 |

* cited by examiner

*Primary Examiner*—Michael R. Mansen
(74) *Attorney, Agent, or Firm*—Fitch, Even, Tabin & Flannery

(57) ABSTRACT

An apparatus for transporting continuous elongate material webs is provided including structure for transporting a material web at a constant speed along a transport path and at least two material web guides arranged along the transport path, at least one guide being arranged upstream and at least one guide being arranged downstream of an intermediate position along the transport path. The upstream and downstream guides are moved relative to each other so as to impart a sinusoidal variation in speed to the material web at the intermediate position. Each guide is eccentrically rotatably mounted so as to move substantially continuously between a position in which a maximum partial length of the material web and a position in which a minimum partial length of the material web is temporarily supported by the guides and the upstream guide moves at the same speed and in the opposite sense to the downstream guide such that the length of the material web is substantially constant between the upstream and downstream guides.

30 Claims, 11 Drawing Sheets

$v_1$
9
8
$v_x$
1
$v_2$
30
$v_y$
4
$v_1$
5
E
D

APPARATUS FOR TRANSPORTING CONTINUOUS ELONGATE MATERIAL WEBS

FIELD OF THE INVENTION

The invention relates to an apparatus for transporting a continuous elongate material web along a production line or the like where the material web is subjected to various processing operations which lead to a final product. The direction of transport of the material web corresponds to the longitudinal extension of the web.

BACKGROUND OF THE INVENTION

In the manufacture of products produced from a continuous elongate material web where each product item is made on or from a discrete length of the web, problems arise in terms of production capacity in the machines in which the maximum machine or transport speed is limited due to the time required to perform an intermittent processing step or operation on the product to be formed on or from the material web. For example, in the manufacture of absorbent articles, such as baby diapers, sanitary napkins, incontinence pads and the like made up of layers of absorbent, liquid permeable and liquid impermeable material, various processing steps such as gluing, ultrasonic welding, fast mechanical processing etc. are required to be intermittently or periodically performed along the whole or less than the whole length of each product. Such processing operations or any other operations to be formed on any kind of product produced on or from an elongate material web or webs moving at a continuous speed past the processing station can result in an overall reduction in productivity because the intermittently or periodically performed processing step cannot be performed at the same speed as another processes to be carried out on the product. Therefore, the slowest processing step determines the maximum machine speed.

An apparatus for transporting an elongate flexible object such as a web wherein the speed of a section of the web is periodically varied while maintaining a constant speed of the upstream and downstream sections of the web is known from WO 95/12491 and WO 95/12539. In this known apparatus, the elongate web is continuously fed past rotating transport rollers which are oscillated parallel to the web in the direction of transport and opposite to the direction of transport thereof. During oscillation, three lengths of the elongate web are mutually parallel to each other so that a length of the web has a relative velocity which can be increased, reduced or reversed with respect to a stationary point by the oscillation of the transport rollers. This permits the performance of a processing operation on the web at a different speed than the constant speed of the web at the upstream and downstream sections of the apparatus. However, the known apparatus is relatively complicated in design and has relatively large moving masses. Additionally, the oscillating motion involves abrupt changes in direction, creating large forces which the apparatus must be designed to withstand.

DISCLOSURE OF THE INVENTION

It is therefore an object of the present invention to provide an apparatus for transporting a continuous elongate material web which is relatively simple in design but simultaneously makes it possible to easily adapt to different operating conditions.

This object is solved by an apparatus for transporting a continuous elongate material web according to the present invention.

The inventive apparatus comprises transport means arranged to transport the material web at a constant speed between a most upstream position and a most downstream position as seen along the path of transport of the material web, and at least two material web guide means arranged between the most upstream and most downstream positions along the transport path, at least one guide means being arranged upstream and at least one guide means being arranged downstream of an intermediate position between the most upstream and most downstream positions. The upstream and downstream guide means are movable relative to each other so as to impart a sinusoidal variation in speed to the material web at the intermediate position. In particular, each guide means is eccentrically rotatably mounted so as to move substantially continuously between a position in which a maximum partial length of the material web and a position in which a minimum partial length of the material web is temporarily supported by the guide means. Further, the upstream guide means moves at the same speed and in the opposite sense to the downstream guide means such that the length of the material web between the most upstream position and the most downstream position is substantially constant.

In accordance with the inventive apparatus, the production capacity is advantageously increased on account of the possibility of increasing as a whole the running or transport speed of the continuous flexible elongate material web through the apparatus while still being able to periodically or intermittently perform a processing step or operation which could not otherwise be performed at the higher constant speed of the web upstream and downstream of the inventive apparatus. This is because the inventive apparatus produces with a very simple structure a superimposed sinusoidal-like variation in velocity, i.e. relative speed of the material web with respect to a fixed point at an intermediate position along the transport path of the material through the inventive apparatus. Consequently, as compared to the constant speed, there is a change in speed of zero, increasing speed, zero, decreasing speed and back to zero at the intermediate position. By adding the sinusoidal-like variation to the constant or normal running speed by means of the inventive apparatus, the velocity through the apparatus gently changes between a value lower than the constant speed and a value higher than the constant speed. Thus, a processing step to be periodically or intermittently carried out on the material web and which requires more time than would be available at the constant speed at which the material web moves along the production line, can be performed during the low velocity period without the overall constant speed being influenced by the slower processing step. It is even possible to reduce the velocity or speed to zero if the process step requires this. Naturally, the apparatus of the present invention is suitable for implementation in a production line in which, when the products are formed along the material web without an intermediate gap between each product, only part of the length of each product along the material web is to be processed in the intermittent or periodic processing step, or, when there is a gap of an appropriately selected length, the whole length of the product can be processed. This is because the low velocity or speed period must be compensated by a high velocity or speed period of the same magnitude so as to maintain the same overall constant speed of the production line, and this compensation requires an unprocessed length along the material web.

Advantageously, the present invention can be realized in any production line requiring a relatively slow intermittent processing step. Such a slow step does not place a limitation on productivity and economy, as an overall higher line capacity can be achieved. Further, an existing production line which up to now has been limited in speed due to a slow processing step can be converted to run at a higher speed with an apparatus according to the present invention provided for the slow processing step.

An important and significant advantage of the inventive apparatus results from the fact that all main rotary parts thereof are rotated at a constant speed so that they must not be periodically accelerated. Therefore, the machine can be simpler in design and does not need to be constructed to absorb sudden increases in force caused by the periodic acceleration of masses as a result of any abrupt change in direction. The running speed of the inventive apparatus is hardly limited since the sinusoidal-like variation in speed is gentle and smooth and large masses do not have to be moved.

A particularly favourable embodiment of the inventive apparatus comprises a pair of upstream guide means and a pair of downstream guide means, each guide means being eccentrically rotatably mounted about a fixed axis of rotation. Further, the two guide means of a respective pair are rotatable in the same direction or opposite directions such as to define a maximum and a minimum distance therebetween. This arrangement provides a relatively simple but stable mechanism by means of which the sinusoidal-like variation in speed of the material web through the apparatus is achieved in a very smooth and gentle manner with no abrupt changes in direction and the resulting undesirable accelerating masses and the forces these produce. All of the guide means are rotated at the same speed and make one revolution per product along the material web so that a slow intermittent processing step can be performed on each product during the low velocity period of the material web. The distance between the respective pairs of guide means in the inventive apparatus can be freely selected such as to create a smaller or larger free length which provides the low velocity period within which the desired slow processing step can be performed. Additionally, it is possible to perform the process on the whole product or several products at the same time so long as the intermittent process is limited to part of the cycle time for one product produced on or from the material web. Additionally, the distance between the rotating centers in each pair of guide means which creates the length variation for each cycle does not strictly depend on the product length. However, the length of material web taken up in a respective pair effects the amplitude of the sinusoidal-like curve of speed variation. A smaller amplitude provides a relatively longer period of time during which the speed of the material web in the inventive apparatus is lowest so as to perform the slow intermittent processing step. Therefore, a relatively flat sinusoidal-like curve with a low amplitude is preferable for performing the intermediate processing step because there is a shorter low velocity period when the speed variation has a larger amplitude.

At least one and preferably all of the inventive guide means comprise an eccentrically mounted drum, shaft or the like about the periphery of which the material web is guided. The peripheral surface is suitably formed or coated or rotatable about its axis of rotation so as to present as little resistance as possible to the material web which is guided by it. This reduces any tensional forces which may be exerted on the material web while it passes through the inventive apparatus. Further, the drum, shaft or the like is advantageously counterbalanced for smoother operation of the inventive apparatus.

According to another preferred embodiment of the invention, at least one upstream and/or at least one downstream guide means are each provided with a compensating means arranged to coact with the associated guide means so as to prevent any slack in the material web along the transport path. This may be necessary, for example, if the material web is flexible and has become slightly elongated during processing. The compensating means can be an eccentrically mounted shaft or the like. Additionally, the compensation means can be used to take up any small difference in length of the material web at the respective guide means if such is present on account of the particular arrangement of the respective guide means.

In accordance with the invention, a material web processing means is provided at the intermediate position and arranged to process the material web periodically or intermittently when the speed of the material web at the intermediate position is at the lower speed period of the sinusoidal-like variation in speed. Advantageously, the processing means can also be movable relative to the material web in the direction of transport of the material web and in the same periodic cycle as the movement of the upstream and downstream guide means. If desired, this arrangement can be used to enhance the effect of the guide means such that the relative speed between the processing means and the material web is low or even zero or almost zero so as to further increase the time within which a relatively slow processing step can be performed by the processing means. Alternatively, the processing means can be movable at a speed which is just enough to reduce the relative speed as compared to the material web so as to follow the moving web and still be able to satisfactorily perform the processing step. In accordance with the present invention, the term processing means should be construed to cover means which perform one or more than one individual processing operation during the processing step.

If necessary, a support means can be provided on the opposite side of the material web to the processing means to support the material web during the processing step. The support means suitably comprises a drum or the like which is rotatable in the direction of transport of the material web and advantageously has a material web support surface which permits relative movement between the drum and the material web. For example, the support surface can be formed by a series of rotatable shafts or the like having rotational axes extending transversely to the direction of transport of the material web. Alternatively, the support surface can be formed of a low friction material. Such a support surface enhances the processing operation with the processing means when there is relative motion between the material web and the processing means and, in particular, when the processing step involves contact of the processing means with the material web.

It is also of advantage in accordance with the inventive apparatus that the support surface of the support means has a pattern formed thereon which is adapted to the shape of the material web or product to be processed. The processing means may also have such a suitably adapted surface if required. In particular, the pattern may consist of grooves, recesses or molds which enhance the positioning of the material web or the product to be formed on or from the material web with respect to the processing means so as to ensure proper alignment for the processing step. This is especially advantageous in the case of relative movement between the material web and the processing means.

According to another advantageous embodiment, the inventive apparatus further comprises at least one conveyor belt movable in the direction of transport of the material web in contact with one side thereof at least between a position upstream of the upstream guide means and a position downstream of the downstream guide means along the transport path. Such a conveyor belt can be used to hold material of or on the material web to prevent it from falling off the material web or to prevent the material web from slipping or being displaced during movement along the transport path and especially during the periods of high velocity or acceleration.

A particularly advantageous further embodiment comprises an apparatus for transporting first and second continuous elongate material webs relative to each other, said apparatus comprising an apparatus for transporting the first material web having transport means and guide means in accordance with the invention as described above such that a sinusoidal-like variation speed of the first material web is produced, and a second transport means arranged to transport the second material web along a path of transport of the second material web separate from the path of transport of the first material web. The second material web transport path crosses the first material web transport path at the intermediate position between the upstream and downstream guide means of the first material web and these guide means are arranged at an angle to the direction of transport of the first material web such that the first material web is guided so as to periodically have a component of movement in the same direction as the direction of transport of the second material web.

This apparatus is particularly advantageous for use in a production line in which an element produced longitudinally along the transport path of the second material web is to be mounted on the product produced along the transport path of the first material web such that it extents at an angle or transversely across the direction of transport of the first material web. Thus, for example, an element of the final product which can be easily produced in the longitudinal running direction of the second material web and must be mounted transversely can be attached under full control to the first material web without having to turn the element by 90°, which would require relatively complicated machinery and could otherwise represent a limitation in respect of the speed at which the main line including the first material web can be run. Although both the main line including the first material web and the auxiliary line including the second material web can be run at constant speed, the provision of an inventive apparatus with guide means which are arranged at an angle such that either the first and/or the second material web has a component of movement in the same direction as the direction of transport of the other material web, results in a lower or even zero relative velocity between the two webs. Thus, a processing step at the crossing point of the two webs can be carried out by simple means and without complicated and time-consuming procedures.

In accordance with a preferred apparatus with crossing first and second material webs as described above, the upstream and downstream guide means of the first material web are arranged at such an angle that there is periodically a zero or almost zero relative velocity of the first material web with respect to the second material web. Thus, by adjusting the angle at which the upstream and downstream guide means cross the principle direction of transport of the first material web, the change in direction of the first material web combined with the sinusoidal-like variation in the speed thereof produces varied speed components of the first material web in the longitudinal and lateral or transverse directions which can be maximized to coincide such that a zero relative speed between the first material web and the crossing second material web can be produced.

In another preferred embodiment of the apparatus having crossing first and second material webs, an inventive apparatus having transport means and guide means for producing a sinusoidal-like variation in the speed of the second material web can also be provided along the production line thereof. In this case, the intermediate position in the apparatus for varying the speed of the first material web and the intermediate position in the apparatus for varying the speed of the second material web overlap. Further, the upstream and downstream guide means of the second material web can also be arranged at an angle to the direction of transport of the second material web. Thus, by appropriately combining the effects of the guide means of both material webs and, optionally, the angles of the guide means to the principle direction of transport of the respective webs, the relative velocity between the crossing webs can be adjusted as desired to provide the optimal conditions for conducting the desired processing step at the crossing point.

The apparatus comprising crossing material webs as described above removes a possible bottle neck in a production line in which a product component which is best produced longitudinally needs to be mounted at an angle or transversely to the direction of movement of the main line. Furthermore, as desired, it is possible by way of the inventive apparatus with the crossing material webs to cross the auxiliary line including the second material web above or below the main line including the first material web. This provides the most options in terms of the design of the final product.

BRIEF DESCRIPTION OF THE DRAWINGS

Further objects and advantages of the apparatus according to the present invention will become apparent from the detailed description of exemplary embodiments of the invention described in detail in the following with reference to the accompanying drawings, in which.

EXEMPLARY EMBODIMENTS OF THE INVENTION

Figure 1:
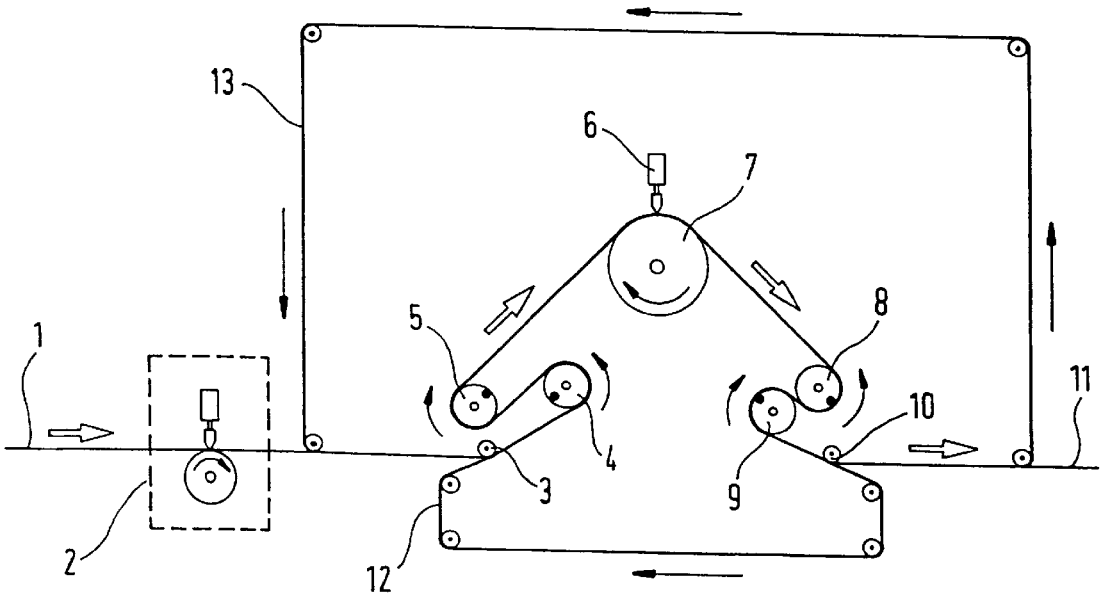
FIG. 1 shows a schematic side elevational view of a first embodiment of an apparatus according to the present invention in which a maximum length of the material web is supported by the upstream guide means.

By way of example, the detailed embodiments of the present invention illustrated in the drawings are described with reference to a production line for absorbent articles such as baby diapers, incontinence pads, sanitary napkins or the like. However, the present invention is not limited to such an application and can be implemented in any production line where an intermittent processing step requiring a slower speed than the constant speed of the production line is to be carried out. The exemplary embodiments of the present invention described with reference to FIGS. 1 to 7 in the following are explained with reference to the production of multi-layered absorbent articles made up from the material web. In particular, an ultrasonic welding process step is shown, although this may also be an intermittent fast mechanical process, gluing process or the like in the production of absorbent articles. The ultrasonic welding process attaches layers of the absorbent article together along a length of the absorbent article which is shorter than the article itself. The absorbent articles are cut in their finished state from the end of the material web. The inventive apparatus permits a production rate of at least 600 to 800 absorbent articles/min.

FIG. 1 shows a schematic side elevational view of a first embodiment on an apparatus according to the present invention through which a continuous elongate flexible material web 1 for a baby diaper or incontinence pad is transported. The material web may consist of a liquid impermeable backsheet, a non-woven core and a liquid permeable top sheet. Further, the material web is folded in the longitudinal direction, i.e. the direction of transport of the material web 1. The material web is transported at a constant speed into and out of the inventive apparatus as illustrated in FIG. 1. Naturally, the constant machine or running speed of the apparatus according to the present invention may vary considerably depending on the nature of the product and the type of manufacturing process or steps to be performed.

Optionally, an ultrasonic welding device can be provided at the most upstream end of the inventive apparatus as seen in the direction of transport of the material web 1. At the high constant speed of the material web, the ultrasonic welding device 2 can slightly weld the folded material together at the location of a side seam in the final product. Such a preliminary weld is advisable in the case of a multi-layered product so as to secure the layers to each other to prevent relative displacement during passage through the inventive apparatus.

Further downstream along the transport path, there is a fixed material web guide shaft which can be provided to suitably position the material web upstream of the upstream guide means. In the present embodiment of the inventive apparatus, the upstream guide means 4 and 5 comprises two eccentrically mounted drums rotatable in bearings at a constant speed about their axes of rotation. The axes of rotation are shown as small black dots at the periphery of the drums 4, 5. In order to define a minimum and a maximum spacing of the two drums 4, 5, the drums are rotated in opposite directions, as indicated by the arrows in FIG. 1. Alternatively, the drums can both be rotated in the same direction. Naturally, instead of drums, the upstream guide means 4, 5 can also be formed of eccentrically mounted shafts or the like so long as an eccentrically mounted rotatable guide surface is provided for the material web 1.

Downstream of the upstream guide means 4, 5 and upstream of the downstream guide means 8, 9 at an intermediate position between the two, there is an intermittent processing means 6. In the embodiment illustrated in FIG. 1, this is an ultrasonic welding device. However, as previously revealed, the processing means can comprise any other device which is required for performing the intended slow processing step along the production line in which the inventive apparatus is used.

Figure 16A:
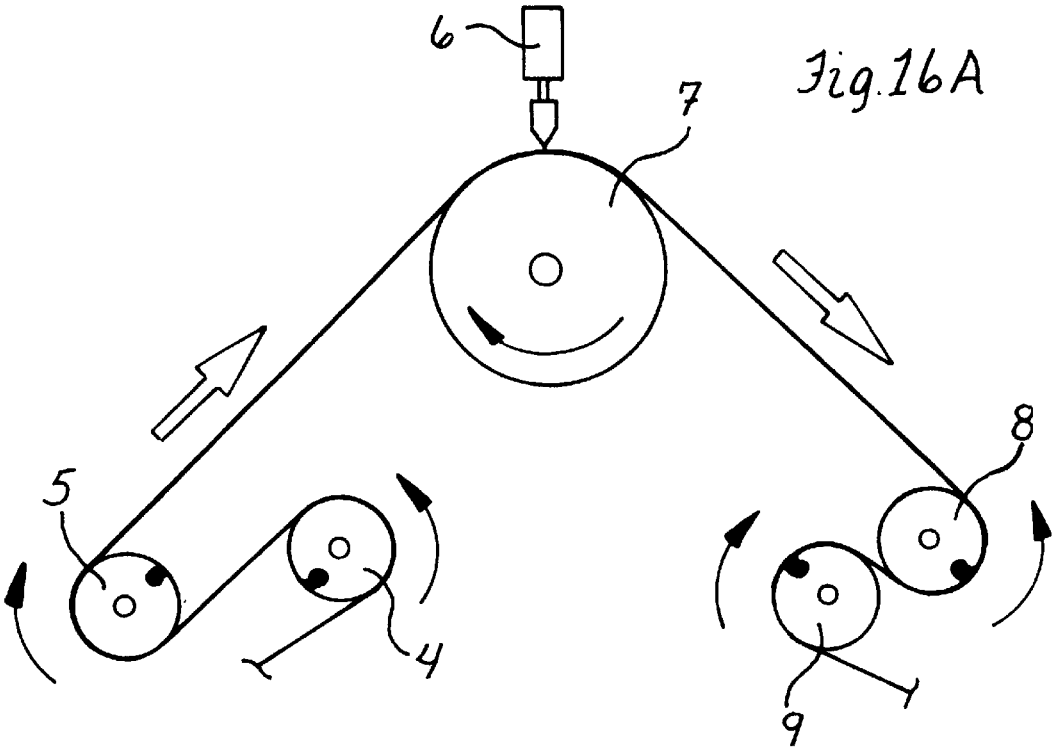
FIGS. 16A and 16B are elevation and plan views, respectively, showing a rotatable pattern drum at an intermediate web processing position between the upstream and downstream guides.
Figure 16B:
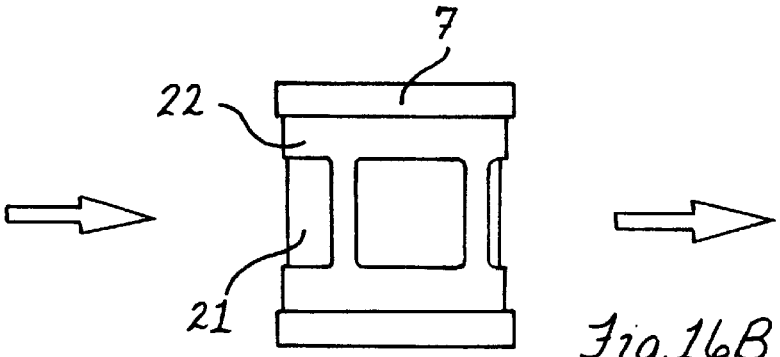
Figure 17:
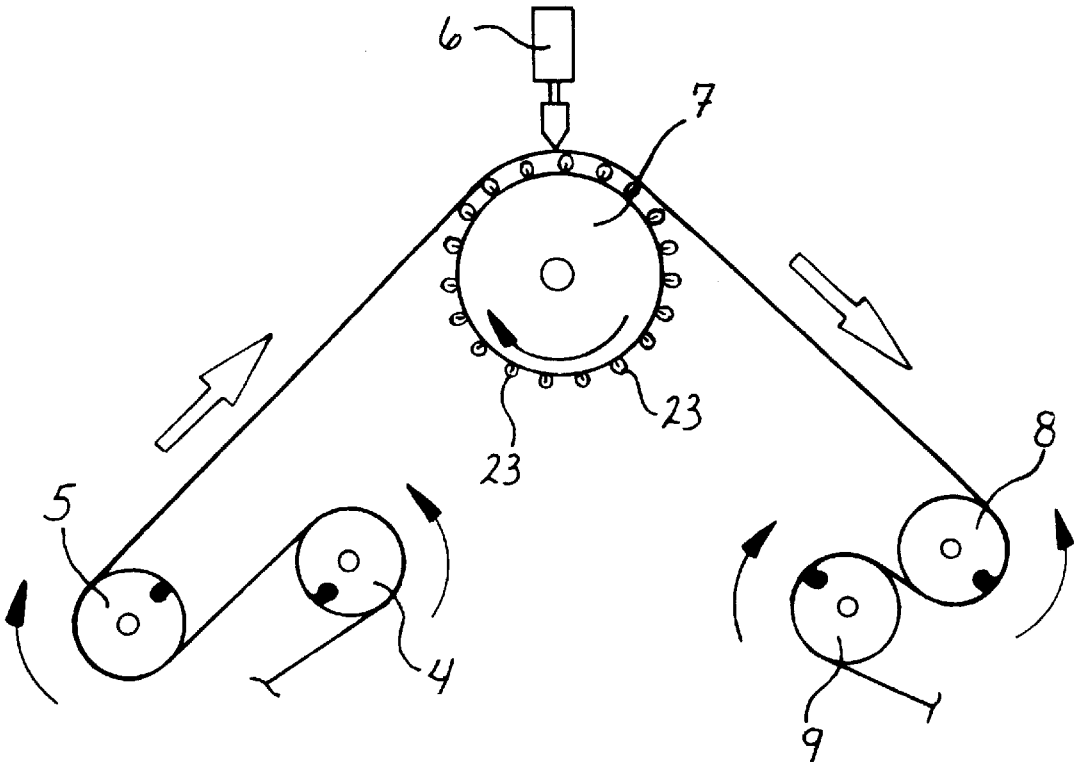
FIG. 17 is an elevational view similar to FIG. 16A showing an alternative drum construction utilizing shafts thereabout.
Figure 18:
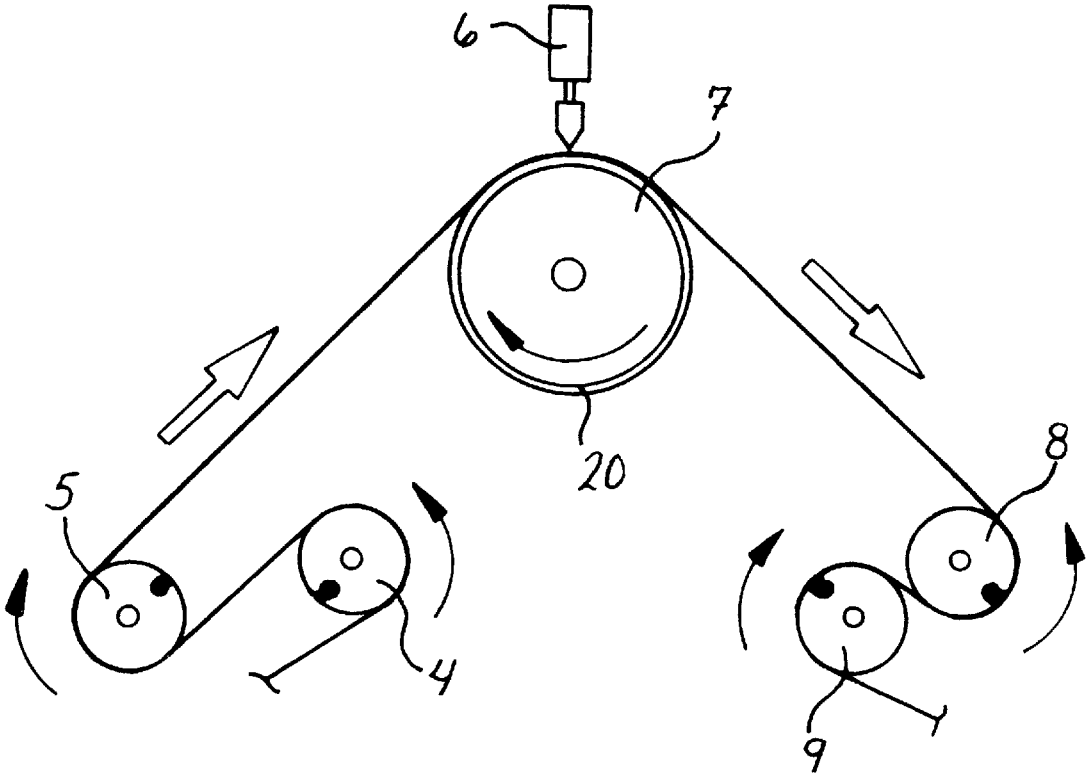
FIG. 18 is an elevational view similar to FIG. 16A showing another drum construction where the drum has a smooth, low friction material on its outer peripheral web support surface.

On the opposite side of the material web to the processing means, there is a support means in the form of a rotatable pattern drum 7. The drum 7 may have a patterned support surface 22 on the periphery thereof for guiding the material web 1, as can be seen in FIGS. 16A and 16B. The pattern may comprise a series of recesses 21 or molds to take up part or all of the products formed on or from the material web 1 when it passes over the drum so that proper alignment is ensured with respect to the processing means 6 for the processing steps. Additionally or alternatively, the support surface of the drum 7 can be provided with a series of small shafts 23 having their axes of rotation extending transversely to the direction of transport of the material web and the drum, as can be seen in FIG. 17. However, the surface can alternatively be formed of low-friction material 20 (FIG. 18) or the material web can be guided on an air cushion formed by air blown through a perforated surface of the drum 7.

Pattern drum 7 may be rotated at a constant speed which is equal to the constant speed of the production line upstream and downstream of the inventive apparatus, minus the sinusoidal-like velocity of the material web. Alternatively, the drum 7 can be rotated at a varying speed which follows the sinusoidal-like velocity of the material web 1. In the event that the drum is rotated at the same varying sinusoidal velocity as the material web, the support surface of the drum 7 may not require the means described above which allow relative displacement between the drum 7 and the material web 1.

As in the case of the upstream guide means 4, 5, the downstream guide means 8, 9 comprises two eccentrically rotatable drums or shafts, the rotational axes of which are shown as black dots in the Figures. The two drums 8 and 9 are preferably rotated in the same direction as means 4 and 5 at the same constant speed so as to define a maximum and a minimum spacing therebetween in which, respectively, a maximum and a minimum length of material web is supported by the downstream guide means. All of the drums 4, 5, 8 and 9 of the upstream and downstream guide means are rotated at the same constant speed so that the length of material web supported by one of the guide means continuously changes from a minimum to a maximum and back to a minimum while the other guide means simultaneously continuously supports a correspondingly greater or smaller length of the material web 1 as compared to the one guide means while the overall length of the material web between the most upstream and most downstream positions of the inventive apparatus remains substantially constant. In this manner, the sinusoidal-like variation in speed of the material web is produced. This is discussed in more detail below with reference to FIGS. 2 to 4.

After material web 1 has left the downstream guide means, it continues along the transport path through the inventive apparatus via a fixed guide shaft or the like 10 to the next processing step as a material web 11 intermittently processed by the processing means 6. Processed material web 11 passes to the next processing step at the same constant speed of the production line as the material web 1 before the latter enters the inventive apparatus. Therefore, the same overall machine speed is recovered again after having carried out a relatively slow processing step within the inventive apparatus.

A conveyor belt 12 can be provided which contacts one side of the material web in order to support this during its passage through the inventive apparatus. A second conveyor belt 13 can also be provided to contact the other side of the material web during transport through the inventive apparatus. In the case of an inventive apparatus in which absorbent articles are produced from the material web, the conveyor belts hold materials such as non-woven core material and prevent this from being torn or blown away from the material web by wind resistance and/or as a result of the change in speed and kinetic energy during the different periods of the acceleration and deceleration cycles of the sinusoidal-like variation in speed of the material web. The conveyor belts 12 and 13 are preferably driven at a constant velocity.

Figure 2:
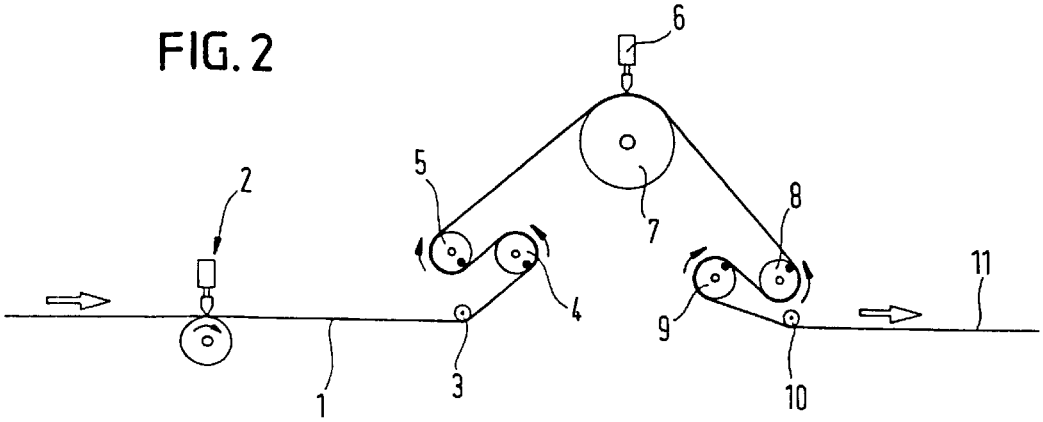
FIG. 2 shows a view of the apparatus according to FIG. 1 in which substantially the same length of material web is respectively supported by the upstream and downstream guide means.

In operation of the inventive apparatus, different lengths of the material web are supported by the upstream guide means 4, 5 and the downstream guide means 8, 9. In FIG. 1, a maximum length of material web is supported at the upstream guide means 4, 5 and a minimum length of material web is supported at the downstream guide means 8, 9. The rotation of the respective drums 4, 5, 8 and 9 of the upstream and downstream guide means is shown by means of arrows and the drums are all rotated at the same speed and preferably at a rate of one product per revolution. Proceeding from FIG. 1, the drums 4, 5, 8 and 9 of the upstream and downstream guide means move into the positions as illustrated in FIG. 2 in which the same length of material web 1 is supported on the upstream guide means as on the downstream guide means. In other words, the drums 4 and 5 of the upstream guide means have moved closer together so that a shorter length of material web is now supported by the upstream guide means. Simultaneously, the drums 8 and 9 of the downstream guide means have been rotated such as to move apart and support that length of the material web 1 which is no longer supported by the upstream guide means. Upon further rotation of the drums 4, 5, 8 and 9, the upstream and downstream guide means arrive in the positions shown in FIG. 3. The minimum length of material web 1 is supported at the upstream guide means and the maximum length is supported at the downstream guide means. This state is opposite that illustrated in FIG. 1. Further rotation of the drums 4, 5, 8 and 9 then results in the positions of the respective guide means shown in FIG. 4, and, although the same length of material web 1 is supported at both the upstream and downstream guide means, this state is opposite that in FIG. 2. Continued rotation of the drums 4, 5, 8 and 9 then returns the upstream and downstream guide means back into the positions illustrated in FIG. 1 so that one cycle has been completed.

Figure 3:
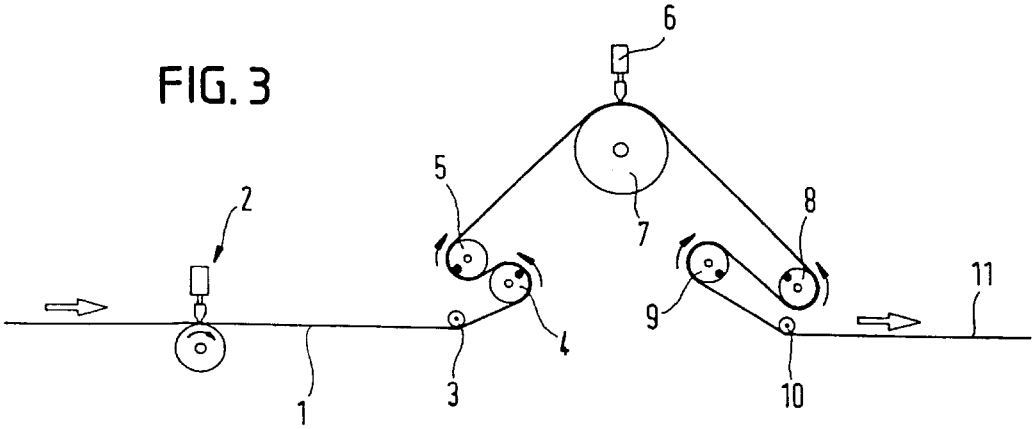
FIG. 3 shows a view of the apparatus according to FIG. 1 in which a maximum length of the material web is supported by the downstream guide means, i.e. the situation opposite that of FIG. 1.
Figure 4:
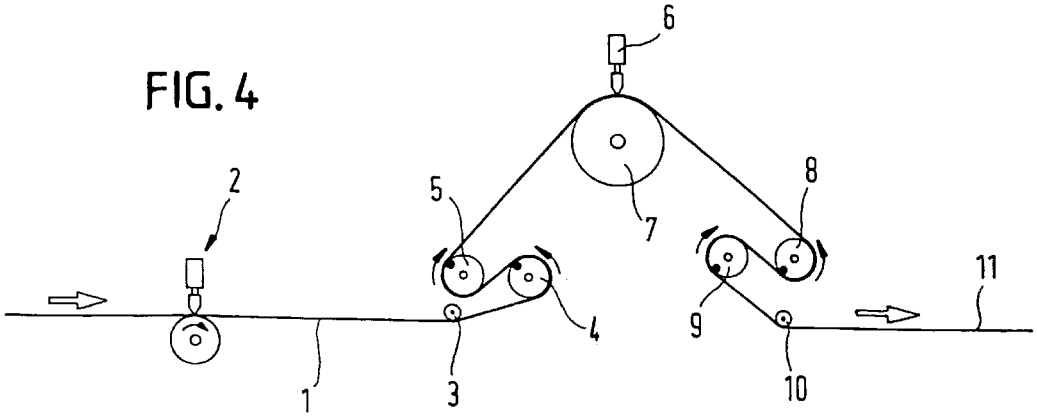
FIG. 4 shows a view of the apparatus according to FIG. 1 in which substantially the same length of material web is supported respectively by the upstream and downstream guide means, but with the guide means in the opposite positions to those of FIG. 2.

It should be noted that the apparatus shown in FIGS. 2 to 4 correspond to that of FIG. 1 and the conveyor belts 12 and 13 have been omitted merely for easier understanding of the drawings.

Figure 5:
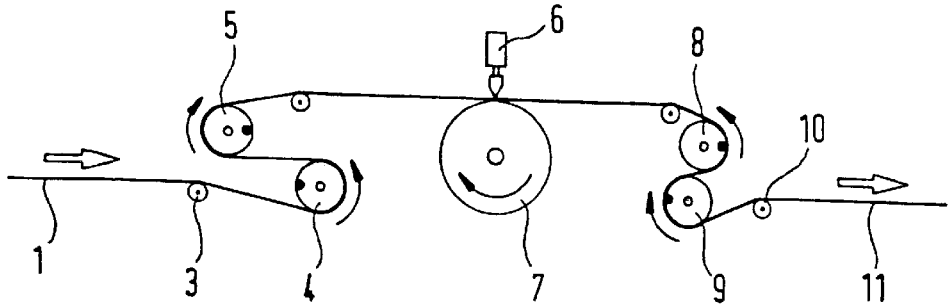
FIG. 5 shows a schematic side elevational view of a second embodiment of an apparatus according to the present invention.

FIG. 5 shows a second embodiment of an inventive apparatus similar to that of FIGS. 1 to 4 in which the material web 1 only touches a short peripheral section of the pattern drum 7 at any one time. This reduces the friction between the drum 7 and the material web 1 which is especially critical during the phase of acceleration of the material web up to the maximum sinusoidal-like velocity part of the cycle. Therefore, this arrangement can be provided as an alternative to the surface of the drum 7 having means such as a series of small rotatable shafts or a low-friction surface already described with reference to FIGS. 1 to 4. Naturally, however, the inventive apparatus according to the second embodiment shown in FIG. 5 can also have such friction reducing means on the surface of the drum 7.

Figure 6:
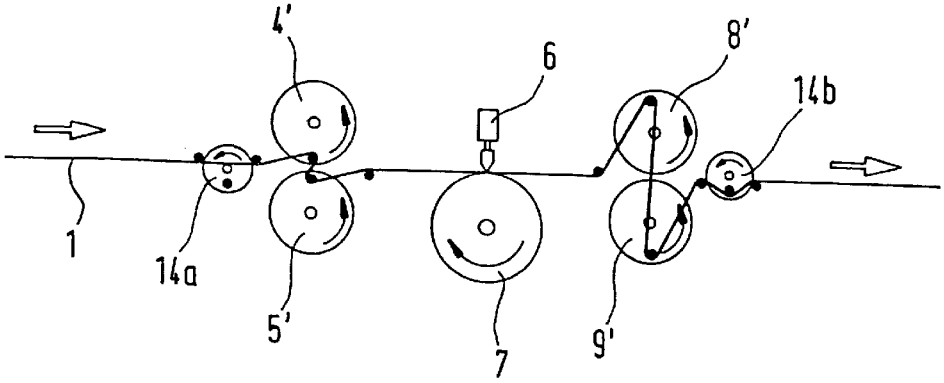
FIG. 6 shows a schematic side elevational view of a third embodiment of an apparatus according to the present invention.

FIG. 6 shows a third exemplary embodiment of the inventive apparatus in which the upstream guide means 4', 5' comprises small diameter rotatable shafts eccentrically arranged on the periphery of large diameter discs or the like mounted at the end of the shafts such as to permit the material web 1 to pass between the discs and over the small shafts. The downstream guide means 8', 9' consists of similar discs and small shafts eccentrically mounted thereon. If there are circumstances during operation of the apparatus according to the invention in which there is a small length difference as compared to the constant length which normally exists in the embodiments described with reference to FIGS. 1 to 5, it may be necessary to provide a material compensator 14*b* such as that shown in FIG. 6 which comprises a small shaft mounted eccentrically on discs attached to its ends or a drum supported on springs. The upstream guide means 4', 5' is provided with a similar compensator 14*a*. Such compensators may also be provided to simply prevent slack in the material web 1 which is produced by slight elongation thereof. This can occur if the material web is flexible.

Figure 7:
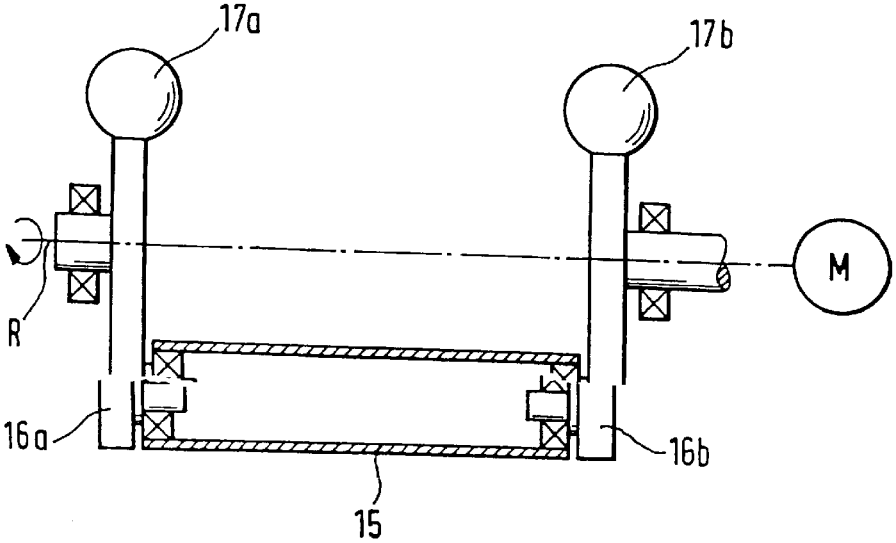
FIG. 7 shows an example of an eccentrically mounted guide means.

FIG. 7 shows one example of an eccentrically mounted guide means. Here, a shaft 15 for guiding the material web is rotatably mounted at its ends in bearings on arms 16*a* and 16*b*. The arms are rotated by a motor M about an axis of rotation R. Additionally, for improved balance, the arms 16*a* and 16*b* extend beyond the axis of rotation R in the opposite direction and have counterweights 17*a* and 17*b* at their ends to counterbalance the shaft at the opposite ends of the arms 16*a* and 16*b* for smoother operations.

In the cycle described above with respect to FIGS. 1 to 4, which can also be performed by the embodiments described with reference to FIGS. 5 to 7, the speed of the material web through the inventive apparatus varies in a substantially sinusoidal manner. However, the speed may also vary other than in a substantially sinusoidal manner so long as a relatively smooth variation in speed takes place throughout each cycle. Very abrupt variations may damage or even completely tear the material web. If, for example, in the case of a sinusoidal variation, the constant speed of the material web before entering the inventive apparatus and after leaving this is 225 m/min. and the ultrasonic welding or a different process step performed by the processing means 6 is possible up to a speed of 120 m/min., then the sinusoidal speed superimposed on the constant speed needs to be +/−105 m/min. Thus, although the constant machine speed is 225 m/min., the welding can be performed at the lowest velocity of 120 m/min. The velocity in the high speed cycle increases to a maximum of 330 m/min., but the overall sinusoidal variation in speed is gentle and without any abrupt changes on account of the respective guide means continuously rotating at the same speed.

Figure 8:
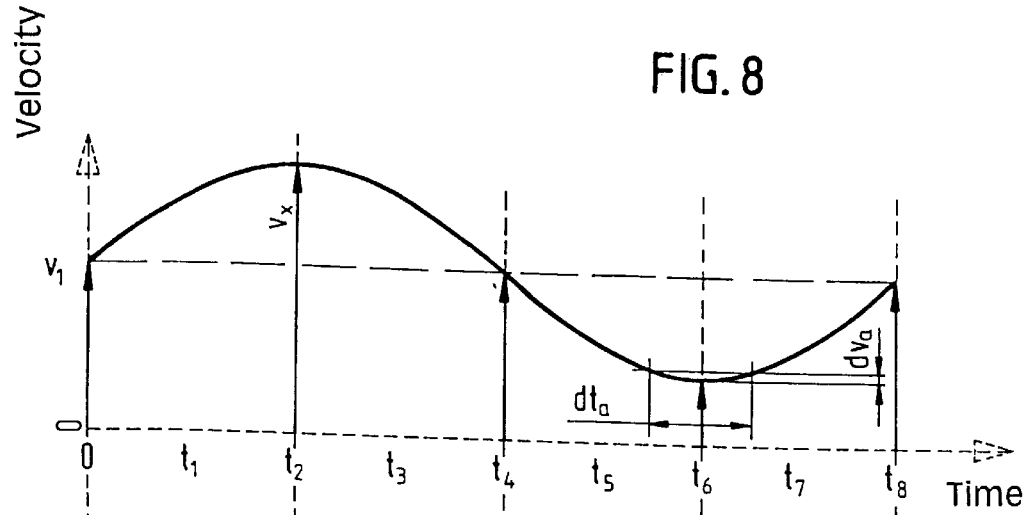
FIG. 8 shows a graph illustrating a first example of a sinusoidal-like variation in speed of the material web in an embodiment of the inventive apparatus.

An explanation of a sinusoidal-like variation in the speed of a material web guided in an exemplary embodiment of the apparatus according to the present invention described with reference to FIGS. 1 to 7 is explained in the following with reference to FIGS. 8 and 9. FIG. 8 shows the sinusoidal-like variation in speed or velocity of the material web 1 with a small amplitude. The graph of FIG. 8 shows the varying sinusoidal-like velocity $v_x$ superimposed on the constant speed $v_1$, the resultant velocity being represented by the sinusoidal-like line. The vertical axis of the graph in FIG. 8 plots the velocity while the horizontal axis plots the time. In the time period f=0 to $t_8$ along the horizontal time axis, th e guide means for the material web have rotated one full revolution and one product has been produced. The curved line of the graph represents the sinusoidal-like superimposed velocity of the material web 1 as measured at the processing means 6 in the embodiments of FIGS. 1 to 7.

At the beginning t=0 of the time axis denoted as Position i in FIG. 8, the situation corresponding to the embodiment described with reference t o FIG. 1 exists. The velocity of the material web 1 is equal to the maximum constant speed $v_1$ upstream and downstream of the guide means 4, 5, 8, 9. The situation represented in FIG. 2 corresponds to the time $t_2$ at Position 2 in FIG. 8. Here the superimposed sinusoidal-like speed or velocity has a positive maximum value and, added to the incoming constant speed $v_1$, this creates a maximum velocity between the upstream 4, 5 and downstream guide means 8, 9 in the apparatus of FIG. 2 which is in the same direction as the constant speed $v_1$. Position 3 at the time $t_4$ in FIG. 8 corresponds to the situation illustrated in FIG. 3. The velocity of the material web 1 is again equal to the constant speed $v_1$ upstream and downstream of the guide means 4, 5, 8 and 9. Position 4 corresponding to the time $t_4$ represents the condition of the inventive embodiment illustrated in FIG. 4. The superimposed sinusoidal-like velocity $v_x$ has in this case a negative maximum value and, added to the incoming constant speed $v_1$, this will create a minimum resultant velocity between the upstream and downstream guide means at the processing means 6 and in the same direction as $v_1$. It is at this position where the processing step at processing means 6 can advantageously take place where the material web is moving at the slowest speed which is less than the constant speed $v_1$. Finally, at the time $t_8$ represented by Position 5 in FIG. 8, the velocity of the material web is again equal to the constant speed $v_1$ upstream and downstream of the guide means 4, 5, 8, 9 and corresponds to Position 1 in which the present embodiment of the inventive apparatus is as described with reference to FIG. 1. Thus, the guide means has completed a full cycle and one product has been processed at the processing means 6. The cycle then begins again as described above with reference to Position 1 of FIG. 8.

Figure 9:
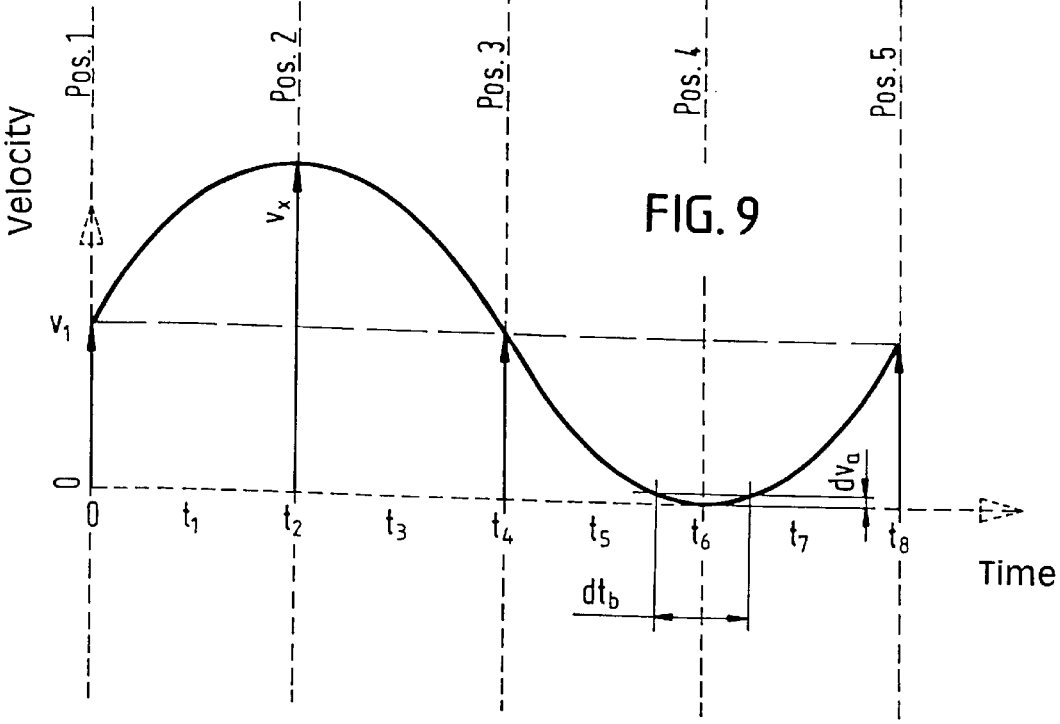
FIG. 9 shows a graph illustrating a second example of a sinusoidal-like variation in speed of the material web in an embodiment of the inventive apparatus.

FIG. 9 also shows a sinusoidal-like velocity of the material web 1, but with a larger amplitude than that of FIG. 8. In this particular embodiment, the arrangement of the guide means is such as to effect an amplitude in the sinusoidal-like superimposed velocity such that the lowest resultant speed at the time $t_6$ corresponding to Position 4 and the condition of the embodiment illustrated in FIG. 4 is zero at the processing means 6 between the upstream guide means 4, 5 and th e downstream guide means 8, 9.

The difference in amplitude of the sinusoidal-like superimposed velocity illustrated in FIGS. 8 and 9 also produces the effect that, at the time $t_6$ corresponding to Position 4 and the condition of the apparatus in FIG. 4, the same change in velocity $dv_a$ as respectively illustrated in FIGS. 8 and 9 takes place over a longer time period $dt_a$ with the smaller amplitude in FIG. 8 than the time period $dt_b$ for the larger amplitude shown in FIG. 9. Hence, by varying the amplitude, the time period at which the velocity of the material web is within a desired range for carrying out the processing step, can be varied.

Figure 11:
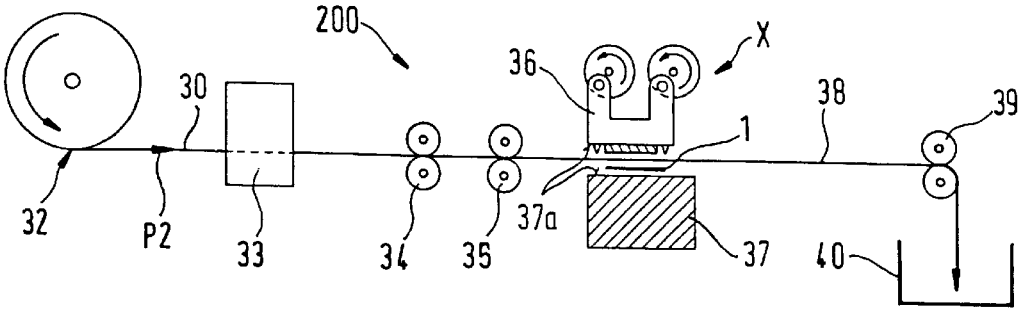
FIG. 11 shows a schematic side elevational view of the auxiliary line crossing the main line in FIG. 10.

FIG. 11 shows an apparatus according to the invention, wherein the processing apparatus is movable relative to the material web in the direction of transport of the material web. Both the upper part 36 and the lower part 37 of the joining and cutting tool are respectively eccentrically mounted in bearings so as to follow each other and the material web 30 in the direction of movement thereof.

FIGS. 10 to 13 show a fourth embodiment of an apparatus according to the present invention. By way of example, this fourth embodiment is described with reference to the production of absorbent articles such as diapers. Where applicable, the same reference signs designate the same parts as previously described with reference to FIGS. 1 to 7.

Figure 10:
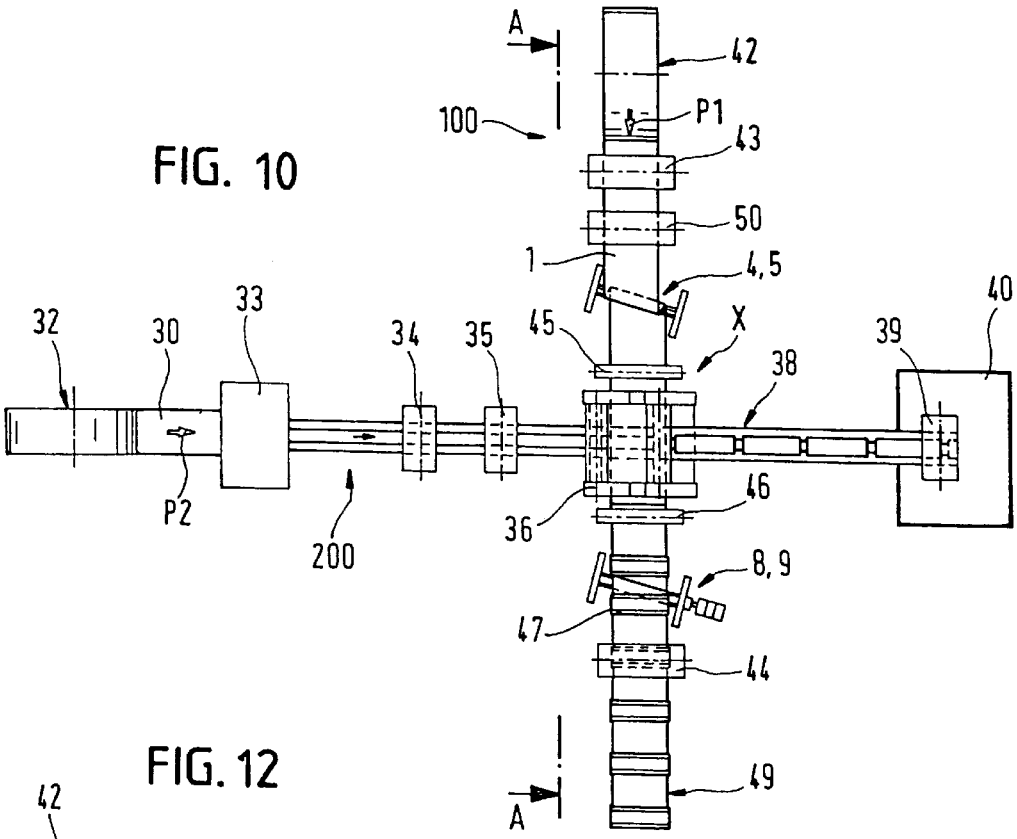
FIG. 10 shows a schematic plan view of a fourth embodiment of an apparatus according to the present invention in which two material webs cross each other.

FIG. 10 shows a schematic plan view of the fourth embodiment of an apparatus according to the present invention in which two webs cross each other. A main line 100 has a transport path along which a first material web 1 is moved in the direction as shown by the arrow P1. An auxiliary line 200 crosses the main line 100 and a second material web 30 is transported along the transport path of the auxiliary line 200 in the direction as shown by the arrow P2. The point at which the auxiliary line 200 crosses the main line 100 is generally designated with reference sign X. In the present fourth embodiment of the inventive apparatus, the first and second material webs 1 and 30 are transported at a constant speed along their respective transport paths.

As shown in FIG. 10 and the schematic side elevational view of the auxiliary line 200 illustrated in FIG. 11, the auxiliary line comprises an unwinding stand 32 for the second material web 30, for example a non-woven material or an elastic material for an absorbent article. A processing unit 33 may optionally be provided to fold the second material web 30, add elastic members, glue and/or ultrasonically weld one or more standing gathers for an absorbent article in a longitudinal or straight line or, if required, in curves, or to perform some other longitudinal process. Further downstream of the second material web 30 along the transport path, a rotation die cutter 34 is provided to make longitudinal cuts in the material web 30 which are used as described below to form a cut piece of material which is to be attached to the first material web 1. Reference sign 35 designates a drive which is synchronous with the main drive of the second material web 30.

At the point of intersection X of the main and auxiliary lines, these intersect at 90° in the illustrated fourth embodiment of the present invention. However, this angle can vary considerably between approximately 15° and 90° depending on requirements. At the point of intersection X in the present exemplary embodiment, there is a joining and cutting tool having an upper part 36 and a lower part 37. Both the upper part 36 and the lower part 37 are respectively eccentrically mounted in bearings so as to follow each other and the second material web 30 in the direction of movement thereof.

The joining and cutting tool 36, 37 is therefore moved at the same speed as the second material web 30 when performing the joining and cutting operation and makes one complete stroke per product. The cutting tool comprises cutting devices 37*a* to cut the second material web 30 transversely to its direction of transport so as to release the precut gather from the second material web 30. This precut part is attached to the first material web 1. At least one of the two webs 1 and 30 has been glued in advance so as to form the bond when the precut is attached to the first material web 1. In order to facilitate the attachment of the precut to the first material web 1, the lower part 37 of the joining and cutting tool comprises elastic material by means of which pressure is exerted on the precut and the first material web so as to join them together. As an alternative to glue, the joining can also be performed by ultrasonic welding or the like. In the event that the precut part is an elastic member, the joining and cutting process can be timed such that the joining takes place before the transverse cuts are made so that the elastic parts are always held in a controlled manner during the joining and cutting operation. As shown in FIG. 11, the second material web 30 passes over the first material web 1. The first material web along the main line can be the material web in a main machine line for producing the final product, or an auxiliary web which leads to the main line. In the embodiment shown in FIG. 11, the first material web is glued on the upper side and led under the crossing second material web 30.

Reference sign 38 designates scrap material remaining after the precut part has been removed from the second material web 30. Reference sign 39 designates another drive synchronous with the upstream drive 35 for the second material web. The scrap material 38 is finally led into a scrap container 40.

Figure 12:
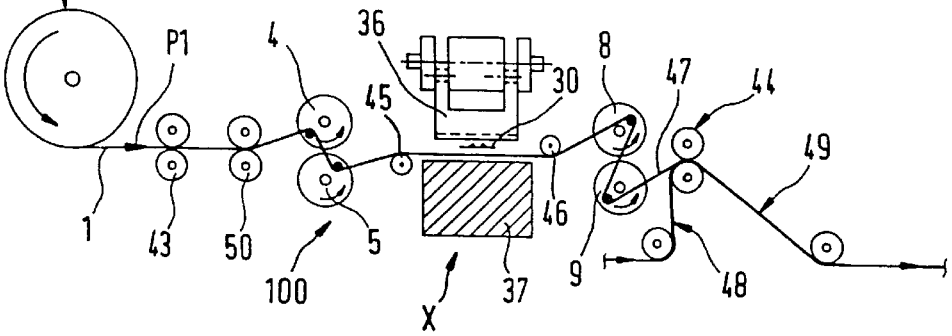
FIG. 12 shows a schematic side elevational view, seen in the direction from line A—A in FIG. 10, of the main line crossed by the auxiliary line.

The main line 100 is similar in construction to the embodiments of the inventive apparatus described above with reference to FIGS. 1 to 7. As illustrated in FIGS. 10 and 12 and seen in the direction of transport of the first material web 1, the main line 100 comprises an unwinding stand 42. If the main line 100 is a sub-line to the production line for the final product, then the material on the unwinding stand 42 can be a non-woven material or the like. The main line 100 further comprises an upstream drive 43 and a downstream drive 44 provided in addition to a main drive (not shown) for the main line. Drives 43 and 44 have the same speed and can be synchronous with the main line drive or differ from this if necessary.

An upstream guide means 4, 5 and a downstream guide means 8, 9 as described with reference to FIGS. 1 to 7 are arranged along main line 100 in such a manner that the point of intersection X of the main line 100 and the auxiliary line 200 lies at the intermediate position between the upstream and downstream guide means.

Figure 13:
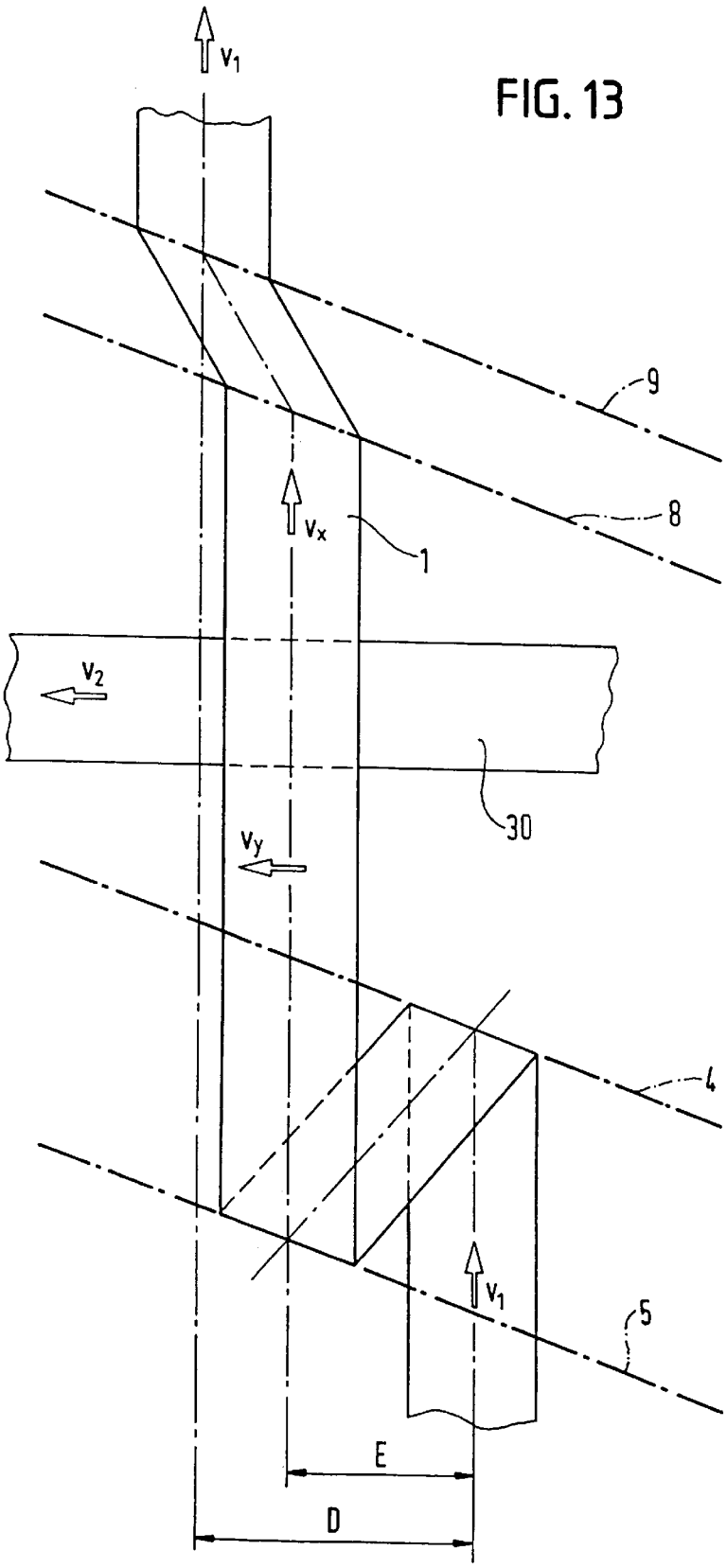
FIG. 13 shows a schematic plan view of the crossing material webs in FIGS. 10 to 12.

As shown in FIG. 10, the upstream guide means 4, 5 and the downstream guide means 8, 9 comprise guide shafts which are arranged at the same angle to the longitudinal extension of the web 1. This arrangement of the upstream and downstream guide means is shown in more detail in FIG. 13. The transport of the first material web 1 at the speed $v_1$ and the rotation of the shafts at constant speeds in this exemplary embodiment produces the sinusoidal-like variation in speed of the first material web 1 as previously described with reference to FIG. 8 or 9. However, on account of the angular arrangement of the shafts 4, 5, 8 and 9 of the respective guide means with respect to the direction of transport of the first material web 1, the first material web has longitudinal and transverse components of movement as compared to the center line of the first material web 1 before it enters the upstream guide means and after it passes the downstream guide means. The longitudinal component of movement of the first material web 1 is parallel to the direction of transport of the first material web 1 (x-direction) and the transverse component is substantially perpendicular to this (y-direction) and substantially parallel to the direction of transport of the second material web 30, which moves at the speed $v_2$. Thus, as also shown in FIG. 13, the sinusoidal variation in speed $v_1$ of the first material web between the upstream and downstream guide means has a longitudinal variable speed component $v_x$ and a transverse variable speed component $v_y$. During operation, the speed components $v_x$ and $v_y$ also vary in a sinusoidal-like manner so that during a certain period of one operating cycle of the upstream and downstream guide means, the speed component $v_y$ is in the same direction as the speed $v_2$ of the second material web 30. In this case, the first material web 1 moves in parallel with the second material web 30 during each such period of each operating cycle of the upstream and downstream guide means. This system is described in more detail below with reference to FIGS. 14 and 15.

It should be noted that the distance D shown in FIG. 13 between the center line of first material web 1 upstream of the upstream guide means 4, 5 and the center line of the web 1 downstream of the downstream guide means 8, 9 is always constant at any time during one cycle of the two guide means so that the first material web 1 is not twisted during its passage between the two guide means. However, the distance E between the center line of the first material web 1 upstream of the upstream guide means 4, 5 and the center line of the first web 1 as the web moves between the upstream 4, 5 and downstream guide means 8, 9 constantly varies.

Figure 14:
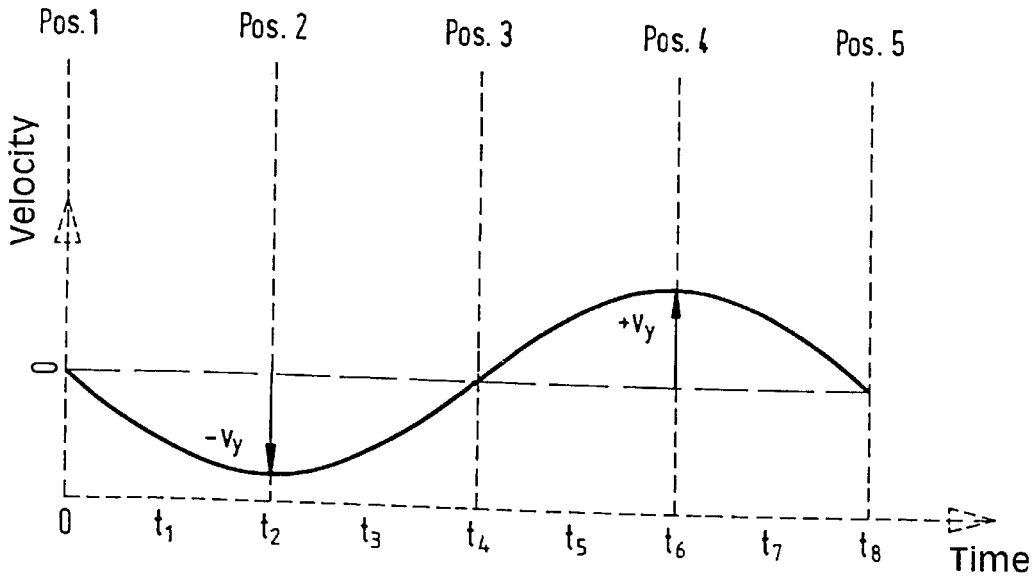
FIG. 14 shows a graph illustrating the sinusoidal-like speed variation in the transverse direction of the main line web in an apparatus according to the embodiment of the present invention described with reference to FIGS. 10 to 13.

The sinusoidal-like velocity of the first material web 1 between the two guide means of the main line 100 in the embodiment of the inventive apparatus described above with reference to FIGS. 10 to 13 is now explained in more detail with reference to FIGS. 14 and 15. The variation in the longitudinal speed component $v_x$ of the first material web 1 takes the basic form of the speed variation already described above with reference to FIGS. 8 and 9. The variation of the transverse speed component $v_y$ of the first material web 1 is shown in FIG. 14. As in the case of FIGS. 8 and 9, the velocity is shown in FIG. 14 in the vertical axis and the time in the horizontal axis. In the time period from t=0 to $t_8$ along the horizontal time axis, the guide means for the first material web 1 has rotated one full revolution and one product has been produced. Additionally, the velocity shown in the vertical axis is zero along the horizontal dashed line in the center of the velocity curve.

At the time t=0 in FIG. 14, the sinusoidal-like transverse speed component $v_y$ is zero and the state of the apparatus forming the main line 100 and the longitudinal speed component $v_x$ essentially corresponds to that described with respect to Position 1 in FIGS. 8 and 9. At this Position 1 in FIG. 14, the distance E described with reference to FIG. 13 has a maximum value. At the time $t_2$ in FIG. 14, $v_y$ has a maximum negative value between the upstream and downstream guide means. The state of the apparatus and the longitudinal velocity component $v_x$ corresponds to that at Position 2 (FIG. 2) described with reference to FIGS. 8 and 9. At the time $t_2$ in FIG. 14, the distance E has a value of half the distance D described with reference to FIG. 13, i.e. D/2. At the time $t_4$ in FIG. 14, the state of the apparatus and the longitudinal speed component $v_x$ corresponds to that at Position 3 (FIG. 3) of FIGS. 8 and 9 and the transverse speed component $v_y$ is again zero. The distance E in FIG. 13 has a minimum value at $t_4$. At the time $t_6$ in FIG. 14, $v_y$ has a positive maximum value between the upstream and downstream guide means. The state of the apparatus of the main line 100 for the first material web 1 and the longitudinal speed component $v_x$ correspond to that at Position 4 (FIG. 4) described with reference to FIGS. 8 and 9. At this time $t_6$, the processing step at the point of intersection X of the main line 100 and the auxiliary line 200 described above with respect to the inventive embodiment illustrated in FIGS. 10 to 12 takes place. The distance E in FIG. 11 has a value of D/2 at this time. Finally, $v_y$ is zero at the time $t_8$ in FIG. 14 corresponding to Position 5 in FIGS. 8 and 9. Therefore, one cycle has been completed and further operation reproduces the sinusoidal-like variation of the transverse speed component $v_y$ beginning at the time t=0 in FIG. 14 (Position 1)

Figure 15:
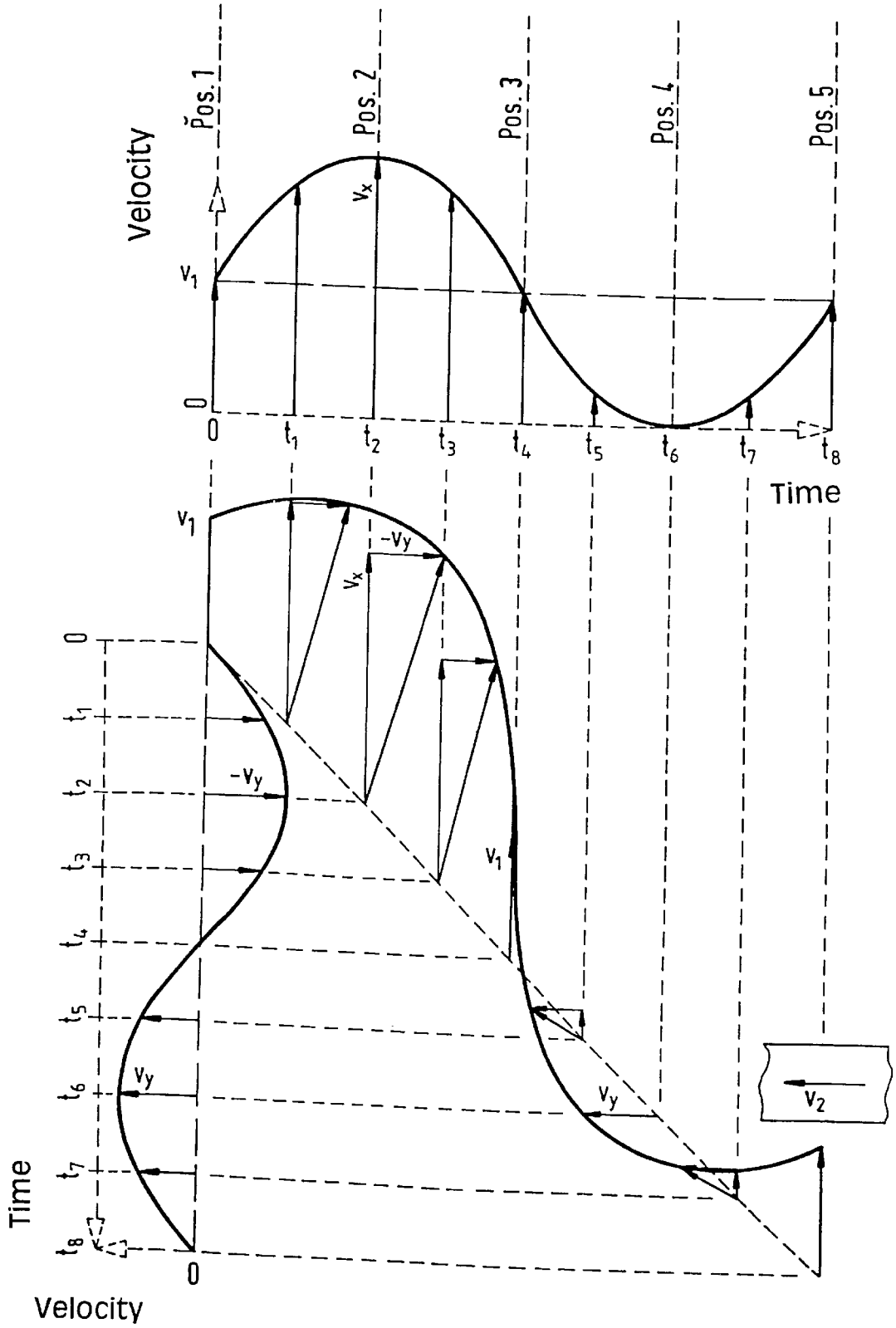
FIG. 15 shows a graph illustrating the resultant velocity of the main line web in an apparatus according to the embodiment described with reference to FIGS. 10 to 13.

The resultant velocity of the first material web 1 between the two guide means in the main line 100 is shown in FIG. 15. The upper curve of FIG. 15 shows the longitudinal speed component $v_x$ and corresponds to that described with reference to FIG. 9 (larger amplitude). The left-hand lower part of FIG. 15 shows the sinusoidal-like speed variation of the transverse speed component $v_y$ of the first material web 1, corresponding to FIG. 14, but turned through 90° and mirrored along the zero velocity line. The middle part of FIG. 15 shows the resultant velocity of the first material web 1 and indicates the direction and value of the resultant speed from the beginning at a time t=0 to $t_8$. The dotted line through the middle of the resultant velocity curve merely serves as a visual aid.

At the time t=0, the situation corresponds to Position 1 (FIGS. 1, 9 and 14), the longitudinal speed component is equal to the maximum constant speed $v_1$ and the transverse speed component $v_y$ is zero. Therefore, the resultant velocity created by adding the velocity vectors $V_x$ and $v_y$ has a value of $v_1$. At Position 2 in FIG. 15 corresponding to the time $t_2$, the longitudinal speed component $V_x$ has a maximum positive value and the transverse speed component $v_y$ has a maximum negative value. At Position 3 in FIG. 15 corresponding to the time $t_4$, the transverse speed component $v_y$ is again zero and the longitudinal speed component $v_x$ has a value $v_1$. Therefore, the resultant velocity also has a value $v_1$, as shown along the resultant velocity curve. At Position 4 corresponding to the time $t_6$, the transverse speed component $v_y$ has a maximum positive value and, on account of the particular amplitude of the sinusoidal-like speed variation produced by the guide means in the main line 100 in this exemplary embodiment, the longitudinal speed component $v_x$ is zero. Therefore, the resultant velocity has the value of the maximum positive speed of $v_y$ which is effective in the same direction as the speed $v_2$ of the second material web 30 illustrated in FIGS. 10 to 13. By appropriately selecting the grade of eccentricity, spacing, angle etc. of the shafts of the guide means, the same value ($v_y$=$v_2$) or substantially the same value of speed of the first material web 1 as the crossing second material web 30 can be produced for ease of processing at the intersection X of the webs, as previously explained. As shown at the bottom-right hand side of FIG. 15, the velocity vector $v_2$ of the second material web 30 is in the same direction as the velocity vector of a positive transverse speed component $v_y$.

Therefore, by appropriately selecting the angle, eccentricity and spacing of the shafts with respect to the speed $v_1$, of the first material web 1, a desirable transverse sinusoidal-like velocity $v_y$ can be produced and, by appropriately selecting the speed $V_2$ of the second material web 30, the relative speed between the transverse component of movement of the first material web 1 and the movement of the second material web 30 can be adjusted as desired and even result in zero relative speed. Therefore, the process such as the joining and cutting step to be performed at the point of intersection X of the first and second material webs can be controlled to take place at the time during the cycle of the sinusoidal variation in speed of the first material web 1 such that the relative speed between the first and second material webs is zero or any other value which is required for said process step. It is particularly important to adjust the relative speed to be as low as possible or zero so that there is no tensioning in either web at the point of intersection during the processing step.

A fixed guide shaft 45 is provided between the upstream guide means 4, 5 and the joining and cutting tool 36, 37 and a further fixed shaft 46 is provided between the tool and the downstream guide means 8, 9 so as to ensure proper transport of the first material web 1 through the joining and cutting tool 36, 37. Downstream of the joining and cutting tool, the material web 1 also comprises the part of the second material web 30 attached thereto, as indicated by reference sign 47. In the event that the main line 100 is a sub-line to the main production line for the final products, the main line 100 and the incoming main production line 48 are joined together as shown in the right-hand side of FIG. 12. A complete web with a transverse standing gather attached to each product results, as shown by reference sign 49.

As described above, the first material web 1 can be guided over or underneath the second material web 30. When it is guided underneath, it is usual to glue the upper side of the first material web 1 for attachment of the precut part of the second material web 30 thereto. However, if a rotary die cutter 50 is also used along the main line 100 and positioned immediately upstream of the upstream guide means 4, 5 to remove a piece of the first material web 1 in the crotch area of a diaper formed from the web to avoid a multiple layer at this location, then the first material web 1 is guided over the second material web 30 of the auxiliary line for the standing gather and tightened corners of the standing gathers in the front and rear of the diaper can be obtained.

Although the fourth embodiment of the present invention described above with reference to FIGS. 10 to 15 is provided with an apparatus for producing a sinusoidal-like variation in speed for the first material web 1 only, it is also possible to provide the auxiliary line 200 with such an apparatus for sinusoidal-like variation of the speed of the second material web 30. In this case, the angle of the auxiliary line 200 to the main line 100, the angles of the respective upstream and downstream guide means in the main and auxiliary lines and the speeds of the two lines can be set in various ways so as to provide a relative speed between the first and second material webs which is most suitable for performing a fully controlled processing step at the point of intersection X of the main line 100 and the auxiliary line 200. Naturally, it is also possible to do without the apparatus for varying the speed of the material web in the main line 100 and to provide such an apparatus in the auxiliary line 200. Further, the main line 100 and/or the auxiliary line 200 can be provided with an apparatus for varying the web speed which substantially corresponds to that described with reference to the embodiments of FIGS. 1 to 7, i.e. without angled shafts.

In the fourth embodiment of an inventive apparatus as described above with respect to FIGS. 10 to 15, an absorbent article can be produced in a very simple manner on account of the fact that an element of the final product which is to be attached across the width of the final product and which can be produced most easily in the longitudinal direction is prepared in the auxiliary line. This can then be attached without rotation thereof to the main line in a controlled manner as described above. Additionally, by providing the separate auxiliary line for the added element of the final product, for example a standing gather, the element can be processed in different ways with curves or straight lines, be glued or welded in an ultrasonic welding device, fixed only at the ends or the like. Further, it is possible to place glue on the side of the material web of the main line and/or the opposite side of the web of the auxiliary line, either of the main or auxiliary webs can be guided over the other at the point of intersection of the main and auxiliary lines, rotary die cutting can be performed to produce curved or straight lines as desired, and the joining and cutting tool or any other tool located at the point of intersection of the main and auxiliary lines can be placed above or underneath the point of intersection depending on the most suitable design of the production line and the processing operation to be performed. Additionally, although the length of the material web between the upstream and downstream guide means in the main and/or auxiliary line normally remains constant, should this not be the case, for example, due to material elongation, it is possible to provide means which slightly adjust the length. Thus, the web can be guided over a drum mounted on springs, a rotating compensator as described with reference to FIG. 6 or the like to compensate the difference in length and prevent slack.

What is claimed is:

1. An apparatus for transporting at least one continuous elongate material web, comprising a transport arranged to transport the material web at a constant speed between a most upstream position and a most downstream position as seen along the path of transport of the material web, and at least two material web guides arranged between the most upstream and most downstream positions along the transport path, at least one upstream guide being arranged upstream and at least one downstream guide being arranged downstream of an intermediate material web processing position between the most upstream and most downstream positions, the upstream and downstream guides being moved relative to each other so as to impart a continuous sinusoidal variation in speed to the material web along the transport path and through the intermediate processing position, each upstream and downstream guide being eccentrically rotatably mounted so as to move substantially continuously between a first position in which a maximum partial length of the material web and a second position in which a minimum partial length of the material web is temporarily supported by the respective guide, and the upstream guide moving at the same speed as the downstream guide and in a first direction between the first and second positions generally opposite to a second direction of movement of the downstream guide between the first and second positions such that the length of the material web between the most upstream position and the most downstream position is substantially constant.

2. An apparatus according to claim 1, wherein the at least one upstream guide includes a pair of upstream guides and the at least one downstream guide includes a pair of downstream guides, each guide being eccentrically rotatably mounted about a fixed axis of rotation and both of the guides of a respective pair being rotatable in the same direction or in opposite directions such as to define a maximum and a minimum distance therebetween.

3. An apparatus according to claim 2, wherein at least one of the upstream and downstream guides has an eccentrically mounted drum or shaft about the periphery of which the material web is guided.

4. An apparatus according to claim 1, wherein at least one of the upstream and downstream guides has an eccentrically mounted drum or shaft about the periphery of which the material web is guided.

5. An apparatus according to claim 1, wherein the at least one upstream guide is provided with a compensating apparatus arranged to coact with said at least one upstream guide so as to prevent any slack in the material web along the transport path.

6. An apparatus according to claim 5, wherein the compensating apparatus is a rotatable drum or shaft eccentrically mounted about a fixed axis of rotation which extends transversely to the transport of the material web.

7. An apparatus according to claim 1, wherein the at least one downstream guide is provided with a compensating apparatus arranged to coact with said at least one downstream guide so as to prevent any slack in the material web along the transport path.

8. An apparatus according to claim 7, wherein the compensating apparatus is a rotatable drum or shaft eccentrically mounted about a fixed axis of rotation which extends transversely to the transport of the material web.

9. An apparatus according to claim 1, wherein the at least one downstream guide and the at least one upstream guide are provided with a compensating apparatus arranged to coact with said at least one downstream guide and said at least one upstream guide so as to prevent any slack in the material web along the transport path.

10. An apparatus for transporting a continuous elongate material web, comprising a transport means arranged to transport the material web at a constant speed between a most upstream position and a most downstream position as seen along the path of transport of the material web, and at least two material web guides arranged between the most upstream and most downstream positions along the transport path, at least one upstream guide being arranged upstream and at least one downstream guide being arranged downstream of an intermediate material web processing position between the most upstream and most downstream positions, the upstream and downstream guides being moved relative to each other so as to impart a continuous sinusoidal variation in speed to the material web along the transport path and through the intermediate processing position, each upstream and downstream guide being eccentrically rotatably mounted so as to move substantially continuously between a first position in which a maximum partial length of the material web and a second position in which a minimum partial length of the material web is temporarily supported by the respective guide, and the upstream guide moving at the same speed as the downstream guide and in a first direction between the first and second positions generally opposite to a second direction of movement of the downstream guide between the first and second positions such that the length of the material web between the most upstream position and the most downstream position is substantially constant, a material web processing apparatus being provided at the intermediate position and arranged to process the material web periodically when the speed of the material web at the intermediate position is at the lowest speed period of the sinusoidal variation in speed.

11. An apparatus according to claim 10, wherein the at least one upstream guide includes a pair of upstream guides and the at least one downstream guide includes a pair of downstream guides, each guide being eccentrically rotatably mounted about a fixed axis of rotation and both of the guides of a respective pair being rotatable in the same direction or in opposite directions such as to define a maximum and a minimum distance therebetween.

12. An apparatus according to claim 11, wherein at least one of the upstream and downstream guides has an eccentrically mounted drum or shaft about the periphery of which the material web is guided.

13. An apparatus according to claim 10, wherein at least one of the upstream and downstream guides has an eccentrically mounted drum or shaft about the periphery of which the material web is guided.

14. An apparatus according to claim 10, wherein the at least one upstream guide includes a compensating apparatus arranged to coact therewith so as to prevent any slack in the material web along the transport path, the compensating apparatus being a rotatable drum or shaft eccentrically mounted about a fixed axis of rotation which extends transversely to the transport of the material web.

15. An apparatus according to claim 10, wherein the at least one downstream guide includes a compensating apparatus arranged to coact therewith so as to prevent any slack in the material web along the transport path, the compensating apparatus being a rotatable drum or shaft eccentrically mounted about a fixed axis of rotation which extends transversely to the transport of the material web.

16. An apparatus according to claim 10, wherein the processing apparatus is movable relative to the material web in the direction of transport of the material web such that the relative speed between the processing apparatus and the material web is zero.

17. An apparatus according to claim 10, wherein a support is provided on the opposite side of the material web to the processing apparatus to support the material web, the support being provided with a drum which is rotatable in the direction of transport of the material web and has a material web support surface which permits relative movement between the drum and the material web.

18. An apparatus according to claim 10, wherein the at least one upstream guide includes a pair of upstream guides and the at least one downstream guides includes a pair of downstream guides, each guide being eccentrically rotatably mounted about a fixed axis of rotation and both of the guides of a respective pair being rotatable in the same direction or in opposite directions such as to define a maximum and a minimum distance therebetween, a support being provided on the opposite side of the material web to the processing apparatus to support the material web, the support being provided with a drum which is rotatable in the direction of transport of the material web and has a material web support surface which permits relative movement between the drum and the material web.

19. An apparatus according to claim 18, wherein the support surface of the support has a pattern formed thereon which is adapted to the shape of the material web to be processed.

20. An apparatus according to claim 17, wherein the support surface of the support has a pattern formed thereon which is adapted to the shape of the material web to be processed.

21. An apparatus according to claim 10, wherein a support is provided on the opposite side of the material web to the processing apparatus to support the material web, the support being provided with a drum which is rotatable in the direction of transport of the material web and has a material web support surface which permits relative movement between the drum and the material web, the support surface of the support apparatus being formed by a series of rotatable shafts having rotational axes extending transversely to the direction of transport of the material web.

22. An apparatus according to claim 10, having at least one conveyor belt movable in the direction of transport of the material web in contact with one side of the material web at least between a position upstream of the at least one upstream guide and a position downstream of the at least one downstream guide along the transport path.

23. An apparatus according to claim 10, wherein the processing apparatus is movable relative to the material web in the direction of transport of the material web such that the relative speed between the processing apparatus and the material web is almost zero.

24. An apparatus according to claim 10, wherein a support is provided on the opposite side of the material web to the processing apparatus to support the material web, the support being provided with a drum which is rotatable in the direction of transport of the material web and has a material web support surface which permits relative movement between the drum and the material web, the support surface of the support apparatus being formed by a low-friction material.

25. An apparatus for transporting first and second continuous elongate material webs relative to each other, having a first apparatus to transport the first material web, comprising a first transport arranged to transport the first material web at a constant speed between a most upstream position and a most downstream position as seen along the path of transport of the first material web, and at least two first material web guides arranged between the most upstream and most downstream positions along the transport path of the first material web, at least one first material web guide being arranged upstream and at least one first material web guide being arranged downstream of an intermediate position between the most upstream and most downstream positions, the upstream and downstream guides being moved relative to each other so as to impart a sinusoidal variation in speed to the first material web at the intermediate position, each first material web guide being eccentrically rotatably mounted so as to move substantially continuously between a position in which a maximum partial length of the material web and a position in which a minimum partial length of the material web is temporarily supported by the first material web guide, and the upstream first material web guide moving at the same speed and in the opposite sense to the downstream guide such that the length of the first material web between the most upstream position and the most downstream position is substantially constant, further having a second apparatus to transport the second material web along a path of transport of the second material web, the second material web transport path crossing the first material web transport path at the intermediate position between the upstream and downstream guides of the first material web, and the upstream and downstream guides of the first material web being arranged at an angle to the direction of transport of the first material web such that the first material web is guided so as to periodically have a component of movement in the same direction as the direction of transport of the second material web.

26. An apparatus according to claim 25, wherein the upstream and downstream guide of the first material web are arranged at such an angle to the direction of transport of the first material web that there is periodically a zero or almost zero relative velocity of the first material web with respect to the second material web.

27. An apparatus according to claim 25 wherein the second apparatus to transport the second material web comprises a second transport arranged to transport the second material web at a constant speed between a most upstream position and a most downstream position as seen along the path of transport of the second material web, and at least two second material web guides arranged between the most upstream and most downstream positions along the transport path of the second material web, at least one second material web guide being arranged upstream and at least one second material web guide being arranged downstream of an intermediate position between the most upstream and most downstream positions, the upstream and downstream second material web guides being moved relative to each other so as to impart a sinusoidal variation in speed to the second material web at the intermediate position, each second material web guide being eccentrically rotatably mounted so as to move substantially continuously between a position in which a maximum partial length of the second material web and a position in which a minimum partial length of the second material web is temporarily supported by the second material web guide, and the upstream second material web guide moving at the same speed and in the opposite sense to the downstream second material web guide such that the length of the material web between the most upstream position and the most downstream position is substantially constant, the intermediate position in the first apparatus for the first material web and the intermediate position in the second apparatus for the second material web overlapping.

28. An apparatus according to claim 27, wherein the upstream and downstream guides of the first material web are arranged at such an angle to the direction of transport of the first material web that there is periodically a zero or almost zero relative velocity of the first material web with respect to the second material web.

29. An apparatus according to claim 28, wherein the upstream and downstream guides of the second material web are arranged at an angle to the direction of transport of the second material web.

30. An apparatus according to claim 27, wherein the upstream and downstream guides of the second material web are arranged at an angle to the direction of transport of the second material web.

* * * * *